United States Patent [19]

Dixon et al.

[11] Patent Number: 4,911,072

[45] Date of Patent: Mar. 27, 1990

[54] SIDE WIPER FOR HIGH SPEED CABLE PRINTER

[75] Inventors: Charles E. Dixon; Geoffrey S. Honeybun, both of Osceola, Ark.

[73] Assignee: Southwire Company, Carrollton, Ga.

[21] Appl. No.: 188,929

[22] Filed: May 2, 1988

[51] Int. Cl.[4] ..... B41F 17/10; B41F 9/10

[52] U.S. Cl. ..... 101/157; 101/36; 101/169

[58] Field of Search ..... 101/36, 37, 169, 157, 101/154, 167, 155

[56] References Cited

U.S. PATENT DOCUMENTS 2,898,848 8/1959 Gillies et al. ..... 101/36

2,898,849 8/1959 Gillies ..... 101/37

2,934,005 4/1960 Gemelli ..... 101/37

3,225,688 12/1965 Gillies et al. ..... 101/36

FOREIGN PATENT DOCUMENTS 152876 5/1952 Australia ..... 101/37

*Primary Examiner*—Clifford D. Crowder

*Attorney, Agent, or Firm*—Stanley L. Tate; Arthur P. Gerstman

[57] ABSTRACT

A wiper for use in a high speed cable printer having a rotatably mounted high speed printing wheel includes a wiper blade holder and at least one wiper blade detachably mounted in the holder for wiping at least one of the side surfaces of the printing wheel.

19 Claims, 4 Drawing Sheets

FIG. 3
(PRIOR ART)
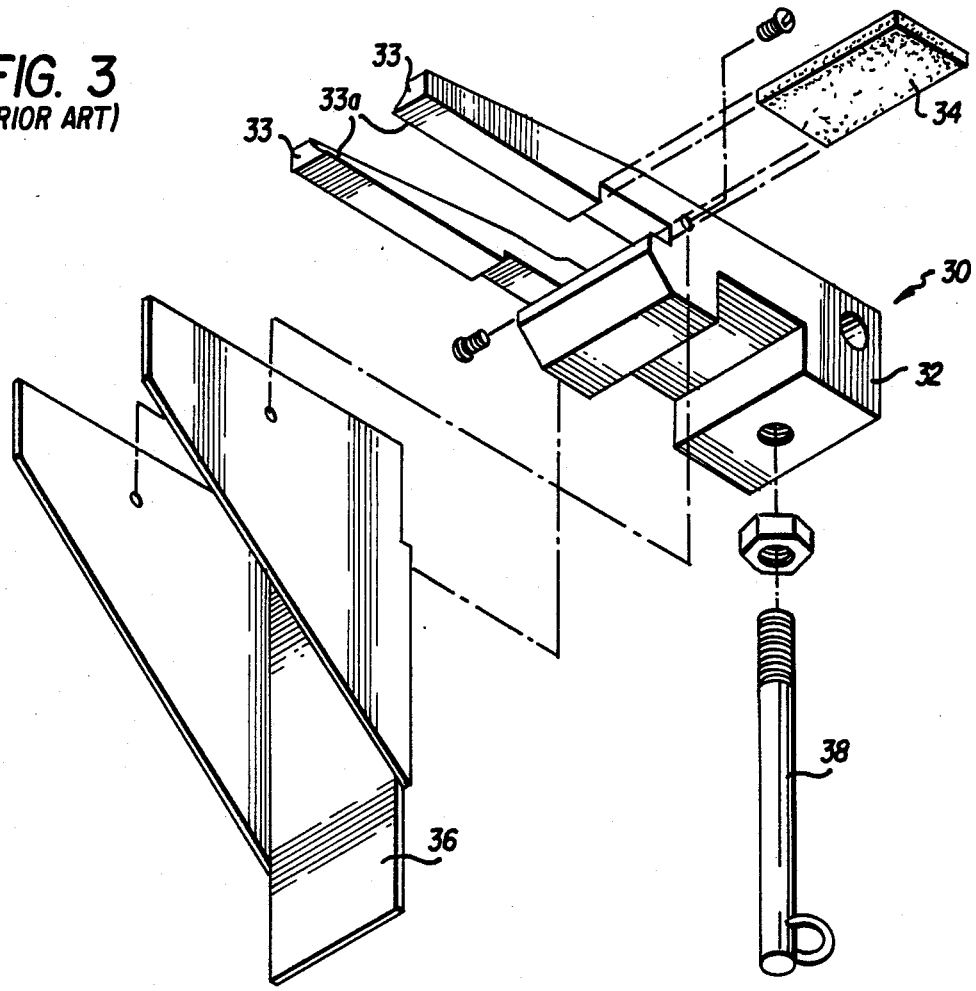
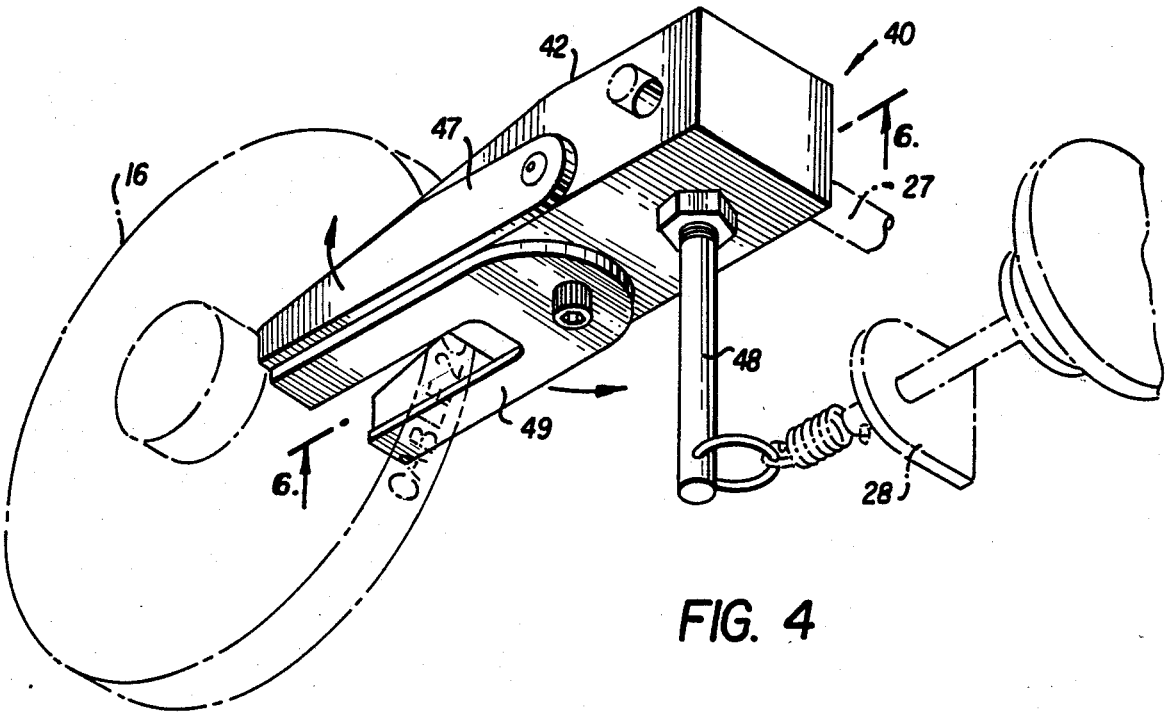
FIG. 4

SIDE WIPER FOR HIGH SPEED CABLE PRINTER

BACKGROUND OF THE INVENTION

The present invention relates to a wiper for the printing wheel of a high speed wire or cable printer and more particularly to such a wiper which wipes the side surfaces of the printing wheel.

High speed printing machines are utilized in the wire or cable manufacturing industry to imprint the cable with indicia indicative of the cable type, Underwriter Laboratories code, manufacturer's identification, etc. These machines typically imprint indicia on a wire travelling at the rate of 4,000 feet per minute, and are known in the industry as "markers."

The markers typically comprise a rotating printing wheel engraved with the indicia to be printed and one or more guide rolls for guiding the cable past the face of the rotating printing wheel. The rotating printing wheel is supplied with a stream of printing ink which is pumped through a nozzle directed to the face of the printing wheel. A wiper for wiping excess ink from the face and sides of the printing wheel is pivotably mounted and spring biased so as to contact the face and sides of the printing wheel to remove excess ink from the wheel. The wiper of the prior art utilizes a machined brass wiper blade holder having a pair of longitudinally extending arms for carrying a nylon wiper blade. The wiper blade holder is so mounted and positioned on the printer as to receive the printing wheel between the arms and wipe the face of the printing wheel with the nylon blade, while wiping the side surfaces of the printing wheel with the extending end surfaces of the arms of the brass wiper blade holder.

However, at the high speeds of rotation of the printing wheel, the brass arms wiping the side surfaces of the printing wheel quickly become worn and printing ink is sprayed between the worn gap, coating the cable with excess ink. To overcome this problem it was necessary to replace the brass wiper blade holder, which involved considerable expense. Additionally, in the prior art a shield was used to ensure that excess ink would not be sprayed through the worn gap, but would be funneled to an ink pot disposed beneath the printing wheel. A more detailed description of the prior art wiper and shield will be found hereinafter in the specification.

SUMMARY AND OBJECTS OF THE INVENTION

In view of the foregoing limitations and shortcomings of the prior art devices, as well as other disadvantages not specifically mentioned above, it is a primary objective of this invention to provide a wiper for a high speed cable printer which does not require frequent replacement of the expensive brass wiper blade holder.

More particularly, it is an object of this invention to provide a wiper for a high speed cable printer which will effectively wipe the side surfaces of the printing wheel, while at the same time is more economical than prior art wipers.

It is another object of this invention to provide a wiper which eliminates the use of a shield surrounding the wiper.

Briefly described, the aforementioned objects are accomplished according to the invention by providing a wiper for use in a high speed cable printer having a wiper blade holder mounted on the housing and means detachably mounted on the wiper blade holder for wiping at least one, and preferably both, of the side surfaces of the printing wheel of the printer. The means for wiping the side surfaces of the printing wheel include a pair of side wiper blades each of which is slidably received in a recess formed in each of the longitudinally extending arms of the wiper blade holder. Means are provided on the wiper blade holder for biasing each of the side wiper blades toward the central longitudinal axis of the wiper blade holder. A cover plate is provided on the wiper blade holder for retaining the side wiper blades in the recesses in the arms of the wiper blade holder.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 3 is an exploded perspective view of the prior art wiper illustrated in FIG. 2.

FIG. 4 is a perspective view of the wiper in accordance with the invention, in position on a printing wheel.

DETAILED DESCRIPTION OF THE PREFERRED EMBODIMENTS

Figure 1:
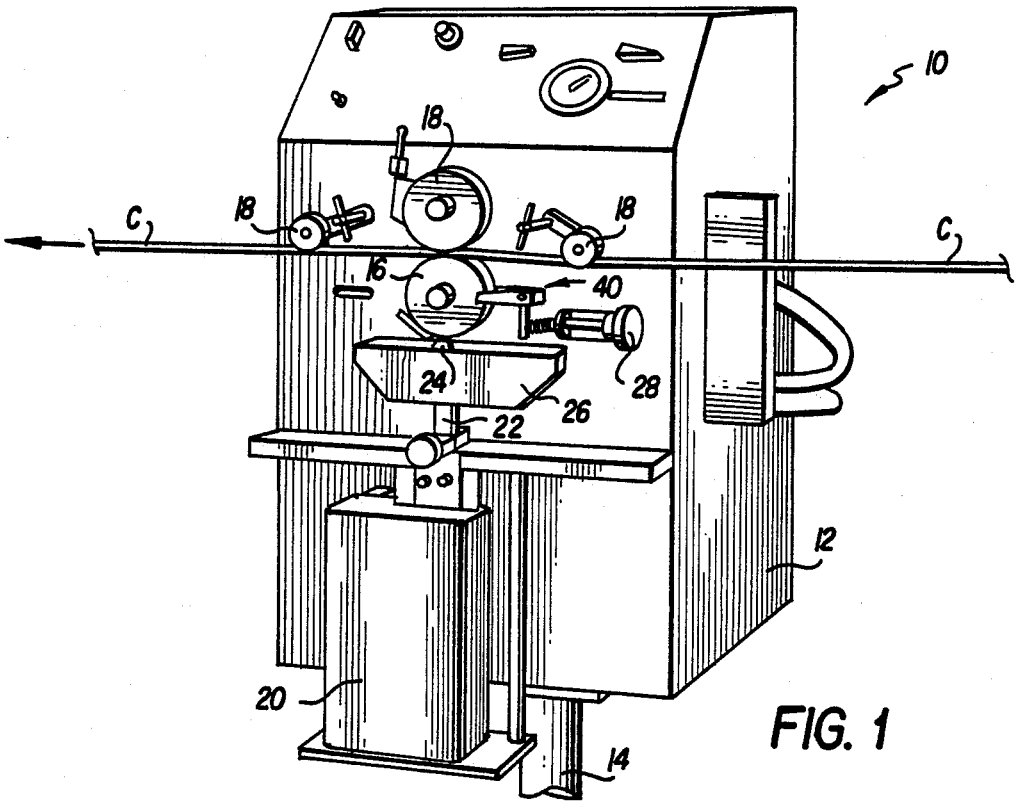
FIG. 1 is a perspective view of a high speed cable printer with a wiper in position on the printer.

Referring now in detail to the drawings wherein like parts are designated by like reference numerals throughout, there is illustrated in FIG. 1 a known high speed cable printer which is designated generally by reference numeral 10. High speed cable printer 10 includes a housing 12 which is supported by a post 14 on a base (not shown). Printer 10 includes a printing wheel 1 which is rotatably mounted on housing 12, and a plurality of guide rollers 18 for guiding a cable C past printing head 16. In the embodiment illustrated in FIG. 1, cable C proceeds past printing head 16 in the direction of the illustrated arrow, or from right to left in the illustrated figure, while printing wheel 16 rotates in the counterclockwise direction of the illustrated figure. Ink is supplied to printing wheel 16 from a replaceable container 20 through line 22 by means of a pump (not shown) to a nozzle 24 disposed directly beneath printing wheel 16. An ink pot 26 is also disposed beneath printing wheel 16 to catch excess ink.

A wiper, generally indicated by reference numeral 40, for wiping excess ink from the face and sides of the printing wheel 16, is pivotally mounted on housing 12 by means of a shaft 27 (see FIG. 4) fixed to housing 12 and is biased against the face of the printing wheel by means of a spring-loaded adjustable tension control assembly 28, which is also fixed to housing 12.

Figure 2:
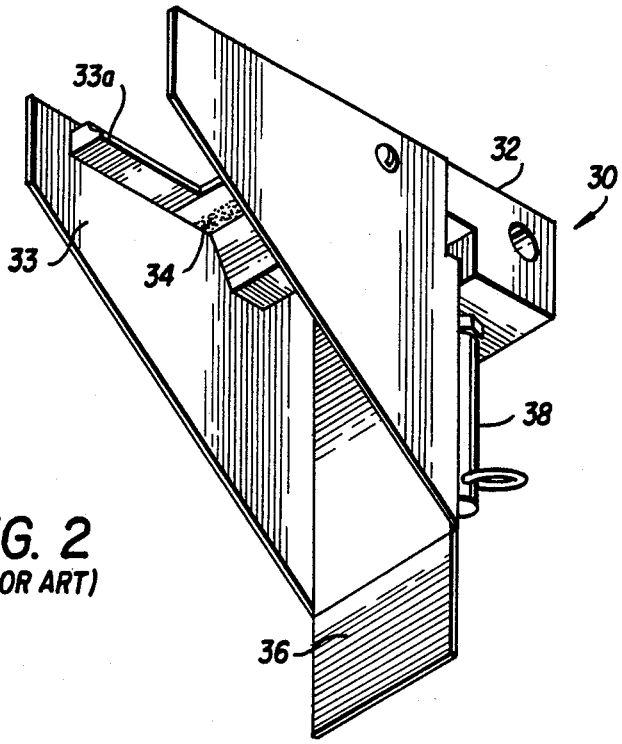
FIG. 2 (PRIOR ART)
FIG. 2 is a perspective view of the prior art wiper.

Referring now to FIGS. 2 and 3, a prior art wiper, designated generally by reference numeral 30, is shown. Wiper 30 is replaced in the high speed printer 10 by the present inventive wiper 40. Prior art wiper 30 comprises generally a wiper blade holder 32, made from a single block of bronze or brass, a nylon wiper blade 34 for wiping the face of printing wheel 16, a skirt 36 for containing excess ink, and a stud 38 for connection of wiper blade holder 32 to tension assembly 28. In greater detail, wiper blade holder 32 is provided with a pair of longitudinally extending arms 33. Each of the arms 33 is provided with an interior surface 33*a*, which surface wipes the respective side surface of the printing wheel 16 to prevent excess ink from being sprayed onto cable C during the high speed printing operation. As surfaces 33*a* become worn, however, ink is sprayed between the surfaces by printing wheel 16, coating cable C with ink, and thus necessitating the replacement of the entire wiper blade holder 32, which is expensive and time consuming. The present invention overcomes this difficulty, as described hereinafter.

Figure 5:
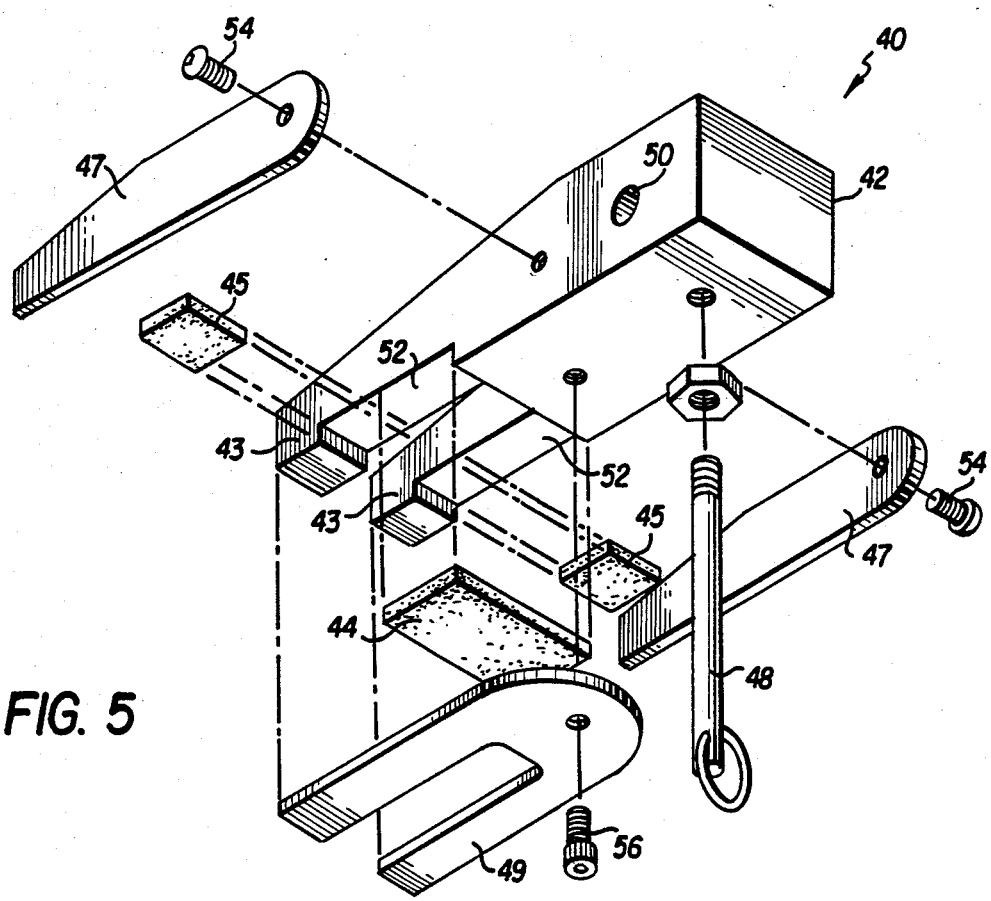
FIG. 5 is an exploded perspective view of the wiper of FIG. 4, in accordance with the invention.
Figure 6:
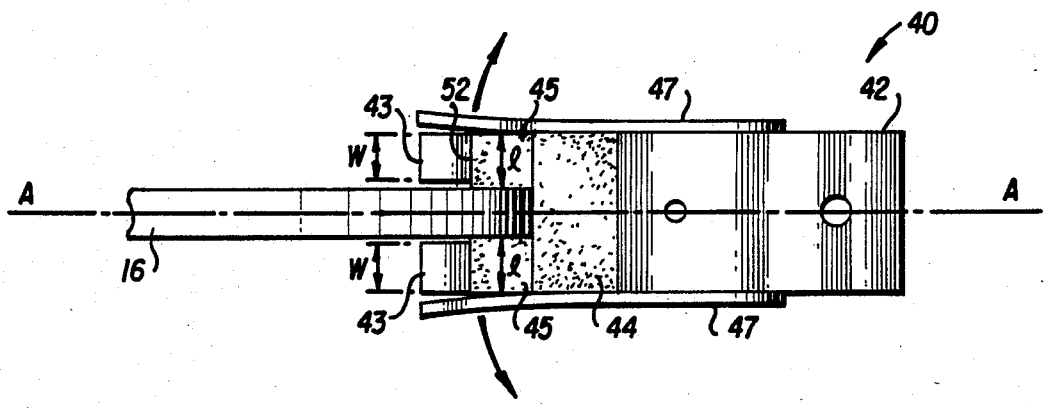
FIG. 6 is a view taken along line VI—VI of FIG. 4 illustrating the wiper of FIGS. 4 and 5 in position on a printing wheel.

Referring now to FIGS. 4, 5, and 6, a first embodiment of the present invention is illustrated. Wiper 40 generally comprises a wiper blade holder 42, a printing wheel face wiper blade 44, a pair of printing wheel side wiper blades 45, a pair of leaf springs 47 for a purpose which will be descried hereinafter, a stud 48 for attachment of wiper blade holder 42 to tension adjustment means 28, and a cover plate 49 for retaining wiper blades 44, 45, 45 in wiper blade holder 42.

In greater detail, wiper blade holder 42 is fabricated, in the preferred embodiment, from a single block of metal, preferably bronze or brass. It will be appreciated, however, that many variations in materials and design of wiper blade holder 42 are possible within the scope of the invention. Wiper blade holder 42 is provided with a through hole 50 for receipt of a shaft 27 (shown in phantom) for mounting wiper blade holder 42 on housing 12. Wiper blade holder 42 is also provided with a pair of arms 43 which extend longitudinally from the body of wiper blade holder 42 and lie parallel to and on both sides of the central longitudinal axis A—A of wiper blade holder 42. A recess 52 is formed in each of the arms 43. Each recess 52 is so sized and dimensioned as to receive both a print wheel face wiper blade 44 and one of the pair of print wheel side surface wiper blades 45. In the preferred embodiment, wiper blades 44, 45 are fabricated from a block of nylon, but it will be appreciated that other modifications of design and material may be made consistent with the present invention.

Attached to each of the side surfaces of wiper blade holder 42 is a leaf spring 47, retained by a suitable fastener 54. Each leaf spring 47 is fabricated from a spring-like material such as spring steel. As will be appreciated most clearly upon a consideration of FIG. 6, the length 1 of the printing wheel side surface wiper blades 45 is somewhat greater than the width w of arms 43 of wiper blade holder 42. Further, leaf springs 47 are positioned so as to bias wiper blades 45 toward the central longitudinal axis A-A of wiper blade holder 42. It is thus apparent, from a consideration of FIG. 6, that side surface wiper blades 45, which are slidingly received in the recess 52, are biased toward the side surfaces of printing wheel 16, when the wiper 10 is positioned for operation on the high speed printer 10, as illustrated in FIG. 1.

Finally, a cover plate 49 is provided on the underside of the body of wiper blade holder 42, connected by a suitable fastener 56, in order to retain wiper blades 44, 45, 45 in recess 52 of wiper blade holder 44. In the embodiment illustrated in FIG. 5 cover plate 49 is formed as a flat plate generally in the shape of a horseshoe. It will be appreciated, however, that many modifications and variations of the illustrated design are possible within the scope of the invention by a consideration of an additional embodiment of the invention to be described hereinafter.

Figure 7:
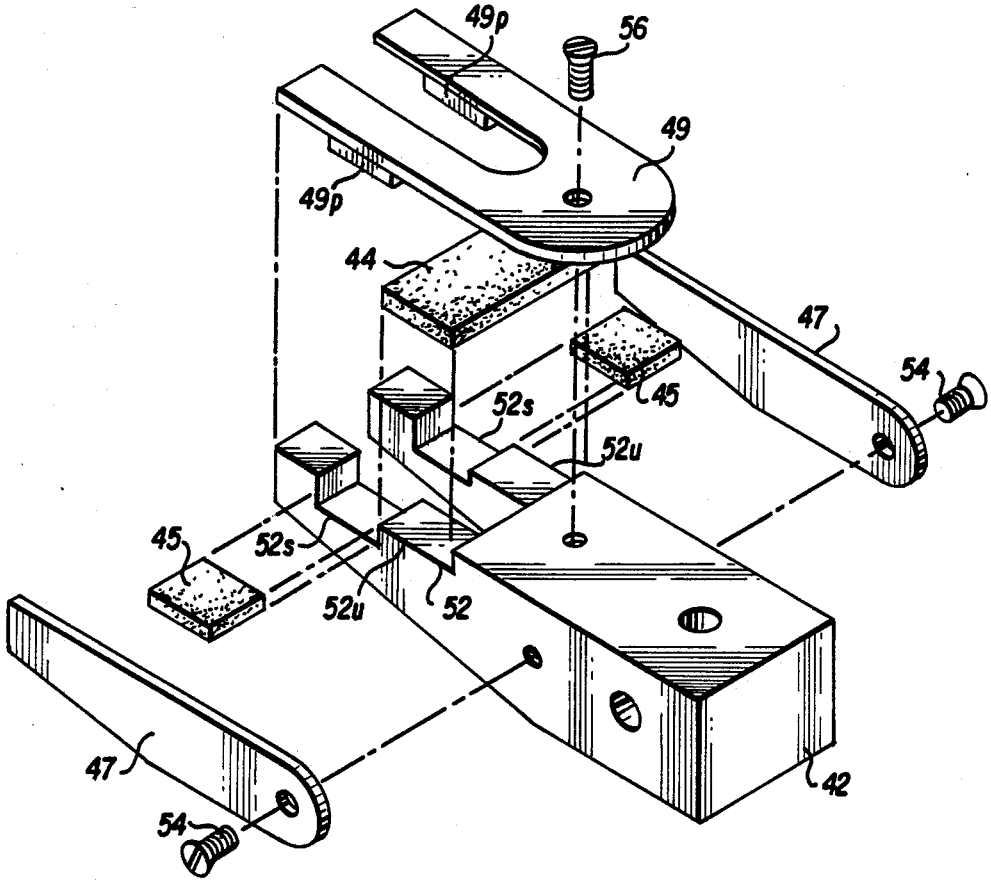
FIG. 7 is an exploded perspective view of an additional embodiment of the wiper in accordance with the invention.

Referring now to FIG. 7, an additional embodiment of the inventive wiper holder is illustrated in perspective view in which the assembly has been rotated 180 degrees about its central longitudinal axis and in which the perspective of the viewer has been changed from a position beneath be wiper, as illustrated in FIG. 5, to a position above the wiper. The embodiment of FIG. 7 differs from the embodiment of FIG. 5 in that each of recesses 52 of wiper blade holder 42 is formed in a step-shape, defining an upper surface 52*u* and a lower surface 52*s*. Lower step surface 52*s* slidingly receives side surface wiper blade 45, while upper surface 52*u* receives printing wheel face wiper blade 44. Further, in the embodiment of FIG. 7, cover plate 49 is provided with projecting pads 49*p* to mate with the lower portion 52*s* of recess 52 and thereby retain side wiper blades 45 therebetween. In other respects, the embodiment of FIG. 7 is the same as the embodiment of FIG. 5, so that a further explanation of the various parts of the embodiment of FIG. 7 is not necessary.

It will further be appreciated that it is possible, within the scope of the present invention, to form recess 52 so that a slight step is provided in the recess, serving merely as a guide for the various wiper blades, with a flat cover plate such as is illustrated in FIG. 5 being provided.

Although only preferred embodiments are specifically illustrated and described herein, it will be appreciated that many modifications nd variations of the present invention are possible in light of the above teachings and within the purview of the appended claims without departing from the spirit and intended scope of the invention.

What we claim is:

1. A wiper for use in a high speed cable printer having a housing, a printing wheel rotatably mounted on said housing, said printing wheel having a printing face and two side surfaces, means for supplying ink to said printing wheel, and means rotating said printing wheel to imprint a wire passing thereagainst, comprising:

a wiper blade holder mounted on said housing, said wiper blade holder comprising a body portion;

means detachably mounted on said wiper blade holder for wiping at least one of the side surfaces of said printing wheel; and means provided on said wiper blade holder for biasing said means for wiping at least one of the side surfaces of said printing wheel toward said at least one of the side surfaces of said printing wheel;

wherein the body portion of said wiper blade holder has opposed side surfaces and said means for biasing said side surface wiping means comprises a leaf spring connected to one of said opposed side surfaces of the body portion of the wiper blade holder.

2. The wiper of claim 1 further comprising means detachably mounted on said wiper blade holder for wiping both of the side surfaces of said printing wheel.

3. The wiper of claim 2 wherein said wiper blade holder comprises a body portion and a pair of arms extending longitudinally from said body portion, each of said arms having a recess formed therein, said means for wiping both of the side surfaces of the printing wheel comprising a pair of side wiper blades, one of each of said side wiper blades being slidably received in one of each of said recesses formed in the arms of the wiper blade holder.

4. The wiper of claim 3 wherein each of said side wiper blades is formed as a nylon block.

5. The wiper of claim 3 wherein said wiper blade holder has a central longitudinal axis, the arms of said wiper blade holder extending longitudinally from the body portion so as to lie parallel to the central longitudinal axis on both sides thereof, and means provided on said wiper blade holder for biasing each of the side wiper blades toward the central longitudinal axis of the wiper blade holder in the respective recesses in which said side wiper blades are received.

6. The wiper of claim 5 wherein the body portion of said wiper blade holder has opposed side surfaces and said means for biasing each of the side wiper blades comprises a leaf spring connected to each of said opposed side surfaces of the body portion of the wiper blade holder.

7. The wiper of claim 6 wherein said leaf springs are made from a spring steel.

8. The wiper of claim 3 further comprising a cover plate provided on said wiper blade holder for retaining said side wiper blades in said recesses in the arms of said wiper blade holder.

9. The wiper of claim 8 wherein the body portion of said wiper blade holder has a bottom surface and said cover plate is connected to said bottom surface of the body portion of said wiper blade holder.

10. The wiper of claim 9 wherein said cover plate has a pair of arms connected by a connecting section, and top and bottom surfaces, wherein said top and bottom surfaces are flat.

11. A wiper for use in a high speed cable printer having a housing, a printing wheel rotatably mounted on said housing, said printing wheel having a printing face and two side surfaces, means for supplying ink to said printing wheel, and means rotating said printing wheel to imprint a wire passing thereagainst, comprising:

a wiper blade holder mounted on said housing; and means detachably mounted on said wiper blade holder for wiping both of the side surfaces of said printing wheel;

wherein said wiper blade holder comprises a body portion and a pair of arms extending longitudinally from said body portion, each of said arms having a recess formed therein, said means for wiping both of the side surfaces of the printing wheel comprising a pair of side wiper blades, one of each of said wiper blades being slidably received in one of each of said recesses formed in the arms of the wiper blade holder;

wherein each of said recesses are formed as a step having a lower level and an upper level, said wiper further comprising a face wiper blade for wiping the circumferential surface of the printing wheel, said face wiper blade being received in the upper level of said step and each of said side wiper blades being slidably received in the lower level of each said step.

12. The wiper of claim 11 wherein the body portion of said wiper blade holder has a top surface, further comprising a cover plate connected to said bottom surface of the wiper blade holder for retaining the face wiper blade and the side wiper blades on the wiper blade holder.

13. The wiper of claim 12 wherein said cover plate has a pair f arms connected by a connecting section and a pad projecting downwardly from each of said arms of the cover plate, each of said pads being so dimensioned and configured as to fit into a respective recess formed by the lower level of the step formed on the arms of the wiper blade holder to retain the side wiper blades on the wiper blade holder.

14. A printing wheel wiper for a printing wheel comprising a body portion having a pair of arms extending in spaced parallel relation therefrom, at least one of said arms having means for slidably receiving side wiper blade for wiping a side surface of the printing wheel and means resiliently biasing said side wiper blade toward the side surface of the printing wheel, wherein said biasing means comprises a leaf spring mounted on the outer surface of each arm in biasing engagement with said side wiper blade.

15. The wiper of claim 14 wherein said slidably receiving means comprise a recess in each arm and a coverplate overlying said recess.

16. The wiper of claim 14 wherein said side wiper blade is made of nylon.

17. The wiper of claim 16 including a nylon face wiper blade for wiping the circumferential surface of the printing wheel.

18. The wiper of claim 17 including a further recess in said body portion for receiving said face wiper blade.

19. The wiper of claim 14 wherein both said arms have means for slidably receiving a side wiper blade and means for resiliently biasing said side wiper blade, said slidably receiving means comprising a recess in each arm and a cover plate overlying each recess, said resilient biasing means comprising a leaf spring mounted on opposing surfaces of said arms in resiliently biasing relation with said side wiper blades.

* * * * *